US007937192B2

(12) United States Patent
Lueger et al.

(10) Patent No.: US 7,937,192 B2
(45) Date of Patent: May 3, 2011

(54) DETECTION OF DERAILMENT BY DETERMINING THE RATE OF FALL

(75) Inventors: Gerhard Lueger, Hartberg (AT); Michael Schmeja, Graz (AT); Gérard Salzgeber, Graz (AT); Christian Kitzmüller, Graz (AT)

(73) Assignee: Siemens Aktiengesellschaft Osterreich, Vienna (AT)

( * ) Notice: Subject to any disclaimer, the term of this patent is extended or adjusted under 35 U.S.C. 154(b) by 1296 days.

(21) Appl. No.: 11/273,408

(22) Filed: Nov. 14, 2005

(65) Prior Publication Data

US 2006/0122745 A1 Jun. 8, 2006

(51) Int. Cl.
*G06F 7/00* (2006.01)
*G06F 17/00* (2006.01)

(52) U.S. Cl. ..... 701/19; 701/29; 701/70

(58) Field of Classification Search ..... 701/19, 701/29, 70; 246/167 R, 170, 171, 172, 163; 33/287

See application file for complete search history.

(56) References Cited

U.S. PATENT DOCUMENTS

| | | | | |
|---|---|---|---|---|
| 3,881,672 | A * | 5/1975 | Gittard | 246/172 |
| 3,929,308 | A * | 12/1975 | Armstrong et al. | 246/169 A |
| 4,783,028 | A * | 11/1988 | Olson | 246/170 |
| 5,742,235 | A * | 4/1998 | Miche | 340/690 |
| 6,023,966 | A * | 2/2000 | Mazur et al. | 73/129 |
| 6,123,298 | A * | 9/2000 | Riley | 246/415 A |
| 6,260,485 | B1 * | 7/2001 | Theurer et al. | 104/7.2 |
| 6,347,265 | B1 * | 2/2002 | Bidaud | 701/19 |
| 6,411,870 | B1 * | 6/2002 | Sato | 701/19 |
| 6,860,453 | B2 * | 3/2005 | Moretti et al. | 246/169 R |
| 7,164,975 | B2 * | 1/2007 | Bidaud | 701/19 |
| 2002/0077733 | A1 * | 6/2002 | Bidaud | 701/19 |
| 2003/0178532 | A1 * | 9/2003 | Moretti et al. | 246/169 R |
| 2004/0122569 | A1 * | 6/2004 | Bidaud | 701/19 |

FOREIGN PATENT DOCUMENTS

| | | |
|---|---|---|
| DE | 19953677 C1 * | 6/2001 |
| EP | 1104734 A1 * | 6/2001 |
| JP | 7079501 | 3/1995 |
| JP | 9039790 | 2/1997 |

OTHER PUBLICATIONS

International Search Report, PCT/AT2004/000173 dated Nov. 2, 2004 (3 pages).

Written Opinion, PCT/AT2004/000173 dated Nov. 2, 2004 (5 pages) (translation 2 pages).

* cited by examiner

*Primary Examiner* — Khoi H. Tran
*Assistant Examiner* — Jorge O Peche
(74) *Attorney, Agent, or Firm* — Anton P. Ness; Fox Rothschild LLP

(57) ABSTRACT

A method and a device for the recognition of a derailment state of a wheel (RAD) of a rail vehicle. The acceleration of the wheel (RAD) is measured perpendicularly to a rail plane (ϵ) with at least one acceleration sensor (SEN), whereby from an acceleration signal (BSI) generated by the acceleration sensor (SEN) by means of simple integration (INT) over a time window of predeterminable magnitude, one determines a fall speed (FAG) of the wheel (RAD) in the direction of the rail plane (ϵ), and whereby on the basis of the determined fall speed (FAG), one examines whether a derailed state exists.

20 Claims, 2 Drawing Sheets

DETECTION OF DERAILMENT BY DETERMINING THE RATE OF FALL

CROSS-REFERENCE TO RELATED APPLICATIONS

This application claims priority from PCT Application No. PCT/AT04/000173 filed May 17, 2004 which claims priority from Austrian Patent Application No. A 746/2003 filed May 15, 2003.

FIELD OF THE INVENTION

This invention relates to a method for recognizing a derailment state of a wheel set of a rail vehicle, where the acceleration of the wheel set is measured perpendicularly to a rail plane with an acceleration sensor.

BACKGROUND OF THE INVENTION

The invention furthermore relates to a device for recognizing a derailment state of a wheel of a rail vehicle, which displays at least one acceleration sensor for the acquisition of the acceleration of the wheel perpendicularly to a rail plane, where the acceleration sensor is fitted out with an analysis unit for the analysis of an acceleration signal generated by the acceleration sensor.

A wheel or wheel set of a rail vehicle, for example, can be subjected to quasistatic accelerations caused by the terrain profile, but also by accelerations caused by derailments. However, with regard to the detection of a derailment, it is only the accelerations that are caused by the movement of the wheel set perpendicularly to the rail plane that are of interest here. In the following, accelerations that work upon the wheel sets perpendicularly to the rail plane will be referred to as fall accelerations. In that sense, the vertical speeds, resulting from these accelerations, will in this document also be referred to as fall speeds.

Such fall speeds can be caused, in case of a derailment, by the ground acceleration and by the primary spring that is being released, whereby the terminal point of this "fall movement" of the wheel or the wheel set is usually determined by a fixed roadway.

Sensors that can measure the proportion of acceleration are not sturdy enough for use on rail vehicles. Sturdy sensors, however, cannot measure the proportion; they have a lower boundary frequency. Slow changes in acceleration thus cannot be acquired. Furthermore, the measurement signals usually display an offset that is subjected to drift phenomena. When one uses sturdy acceleration sensors, it is not the quasistatic parts of the acceleration of the wheel set, but rather primarily drift phenomena and low-frequency electromagnetic inputs that result in the amplitude curve of the generated acceleration signals.

German Patent No. DE 199 53 677 C1 discloses a method of the kind mentioned above. The known document describes a method for recognizing a derailment of a track-bound vehicle. For this purpose, an acceleration of a structural element of the track-bound vehicle, which element is directly or indirectly in contact with the track, is determined vertically and/or laterally with respect to a direction of movement. The acceleration signal is integrated doubly over the time and this doubly integrated acceleration signal is compared to an upper and/or lower boundary value, whereby a derailment has taken place when the boundary value is either exceeded or not attained.

There is one disadvantage connected with this known embodiment in that the double integration brings about a very poor signal-to-noise ratio. For instance, a simple integration can reduce the signal-to-noise ratio by 20 dB per decade of the signal that is to be integrated. A double integration will reduce the signal-to-noise ratio already by 40 dB per decade. Thus, in case of a double integration, a low-frequency jamming signal is amplified by a factor of 10 (20 dB) more than the actual useful signal—the fall acceleration. Stiff requirements are established for the analysis electronics by double integration, as a result of which, the production costs can turn out to be high. Furthermore, using the known method or system, there can be delays in the recognition of derailed states due to the required expensive analysis electronics.

It is therefore the object of the invention to provide a way that makes it possible in a simple, reasonably priced and fast manner to recognize a derailment of a wheel set with a high degree of reliability.

BRIEF SUMMARY OF THE INVENTION

This problem is solved according to the invention with a method of the kind mentioned initially: From an acceleration signal that is generated by the acceleration sensor by means of simple integration via a magnitude predetermined during a time window, one determines a fall speed of the wheel in the direction of the rail plane, and on the basis of the determined fall speed, one determines whether there is a derailed state.

It is to the credit of the invention that the recognition of a derailed state is considerably simplified by the determination of the momentary fall speed by means of a simple integration of the acceleration signal. Simple integration results in an essentially better signal-to-noise ratio than in the case of multiple integration; therefore, the requirements for the analysis electronics are not as stiff any longer either. In other words, this facilitates a simple and reasonably priced structure of the analysis electronics. Furthermore, the invention-based solution facilitates a simple, exclusively hardware-based implementation, as a result of which, the reliability of derailment detection can be further enhanced.

In a first variant of the invention, the value of the fall speed is compared to a boundary fall speed, whereby one can recognize a derailed state when the boundary fall speed is exceeded.

According to a second variant of the invention, one can conclude that there is a derailed state from the time curve of the fall speed.

In a preferred embodiment of the invention, the acceleration signal is generated in the area of the axle bearing. Low-frequency jamming portions, contained in the acceleration signal, are eliminated prior to integration in order to improve the signal analysis and to increase the sturdiness of the method against the influence of jamming. A high-pass filter is used advantageously to eliminate the jamming portions.

In order to be able correctly to reproduce the development of the fall movement by integration, group running time of the individual frequency parts of the acceleration signal that is to be integrated will be kept constant during filtration. Advantageously, the integration of the acceleration signal is in each case performed in successive time windows, whereby the terminal point of a time window will form the starting point of the next following time window. The integration of the acceleration signal, however, can also be performed in each case in successive time windows, whereby successive time windows will overlap each other section by section.

Suitable for the implementation of the invention-based method is especially a device of the kind mentioned initially, where the analysis unit is set up as follows: to determine the fall speed of the wheel in the direction of the rail plane from a magnitude that can be predetermined over a time window by simple integration, and on the basis of the determined fall speed, one can now examine whether a derailed state exists.

Preferably, the analysis unit is so set up that it can compare the determined fall speed with a boundary fall speed, whereby one can recognize a derailed state when the boundary fall speed is exceeded. Furthermore, the analysis unit can be so set up that one can recognize a derailed state on the basis of the time curve of the fall speed.

In an advantageous embodiment of the invention, the acceleration sensor is arranged in the area of an axle bearing of a wheel of the rail vehicle. Furthermore, one can provide a filter for the elimination of low-frequency jamming parts present in the acceleration signal prior to integration, where the filter favorably is a high-pass filter. Moreover, the filter essentially exerts no influence on the phase relationships of frequency parts of the acceleration signal.

Additional advantages can be achieved in the following manner: The analysis unit is so set up that the integration of the acceleration signal can in each case be performed in successive time windows, whereby the terminal point of a time window forms the starting point of a subsequent time window.

In another variant of the invention, the analysis unit can also be set up in order to perform the integration of the acceleration signal in each case in successive time windows, whereby successive time windows will overlap each other segment by segment.

Advantageously, an acceleration sensor is arranged in the area of each wheel of the rail vehicle.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
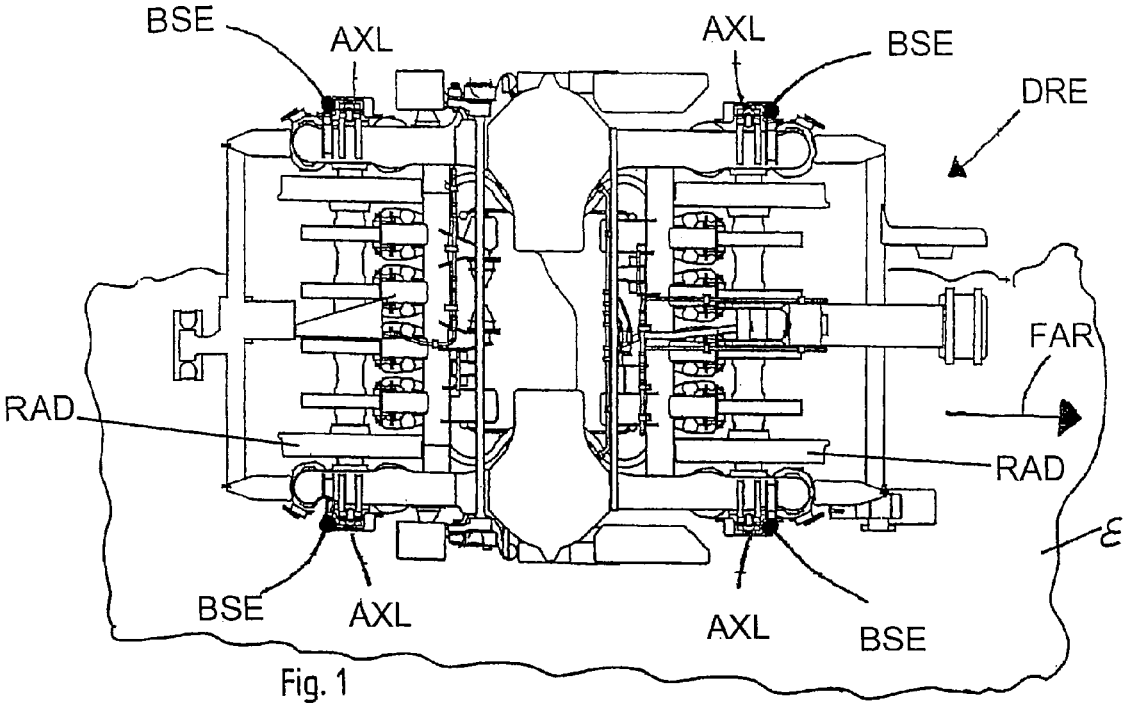
FIG. 1 is a rail vehicle with a device for the implementation of the invention-based method.

In the drawings, like numerals indicate like elements throughout. In the drawings, like numerals indicate like elements throughout. Certain terminology is used herein for convenience only and is not to be taken as a limitation on the present invention. The embodiments illustrated below are not intended to be exhaustive or to limit the invention to the precise form disclosed. These embodiments are chosen and described to best explain the principle of the invention and its application and practical use and to enable others skilled in the art to best utilize the invention.

According to FIG. 1, to implement the invention-based method for the purpose of recognizing a derailed state of a rail vehicle, an acceleration signal is generated in the area of a truck DRE of the rail vehicle. For this purpose, an invention-based device has an acceleration sensor BSE that can be arranged on an axle bearing AXL of a wheel RAD or wheel set of the rail vehicle. An acceleration sensor BSE is arranged favorably in the area of each wheel RAD, for example, on each axle bearing AXL.

An essential element of the invention at hand is represented by the realization that one can achieve particularly reliable and representative measurement results when the direction of action of the acceleration sensors BSE extends essentially perpendicularly to the direction of movement, that is to say, perpendicularly to a rail plane $\epsilon$. The drawing shows a direction of movement of the rail vehicle with an arrow FAR, where the action direction of the acceleration sensors BSE extends perpendicularly upon the plane of the drawing. By action direction of an acceleration direction BSE, we mean, in this document, the direction in which the sensor can preferably receive acceleration forces and can deliver signals.

The acceleration sensors BSE, for example, can be made as piezoelectric sensors where, in the known manner, a piezoelectric crystal is arranged between two parallel-extending condenser plates. When this type of sensor is used, then since both condenser plates essentially extend perpendicularly to the direction of the rail vehicle, one can attain agreement between the action direction of the acceleration sensors and the movement direction. Naturally, one can also use other known acceleration sensors that are based on other mechanisms. The expert is familiar with many such sensors and they will therefore not be explained in any greater detail at this point.

Figure 2:
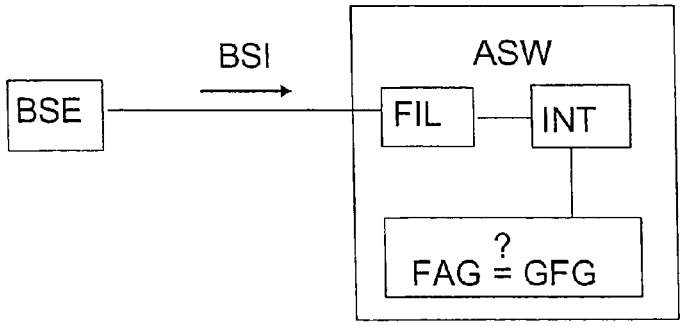
FIG. 2 is a block diagram of the invention-based device.

The acceleration signal BSI, generated by the acceleration sensor BSE, is transmitted according to FIG. 2 into an analysis unit ASW, whereby the transmission of the acceleration signal BSI can be accomplished by the acceleration sensors BSE to the analysis unit ASW via electrical lines, glass fiber or wireless cables, for example, via radio or Blue Tooth. The analysis unit can be a correspondingly programmed microprocessor or signal processor, although in a preferred embodiment of the invention, preference is given to a purely hardware-engineering implementation of the analysis unit ASW for reasons of greater security.

From the acceleration signal in the analysis unit ASW by means of simple integration INT via a time window of predeterminable magnitude, one determines the fall speed FAG of the wheel RAD or the wheel set in the direction of the rail plane $\epsilon$. The integration of the acceleration signal BSI in each case can take place in successive time windows or during successive time intervals, whereby the terminal point of a time window can form the starting point of a following time window. Furthermore, it is also possible that successive time windows might partly overlap each other. Basically, there can also be a time interval between two successive time windows.

The integration of the acceleration signal BSI can take place in a digital or analog manner. Circuits and methods for numerical or analog integration of a signal over a predeterminable time span are known to the expert in large numbers and will therefore not be explained here in any greater detail.

After calculation of the current fall speed FAG of the wheel RAD in the time window considered or of the wheel set considered, said speed is compared to a boundary fall speed GFG, whereby one can recognize a derailed state when this boundary speed is exceeded. The fall speed that is determined in this considered time window in case of a derailment will take on values which can never be attained in a normal condition (for example, when the train runs over switches)—during routine operation, the occurring speed level differences for acceleration to high speeds are too slow—which is why one can determine a derailment with a very high degree of probability. In other words, the value of the integral of the acceleration signals over the time window under consideration in case of a derailment will assume values that cannot be attained during routine operation.

First of all, on the basis of the value of the determined integral—whose upper and lower boundaries are determined by the particular time window considered—of the acceleration signal, one can conclude that there is a derailment. Besides, from the curve of the fall speed as a function of the time in the time interval considered, one can also conclude that there is a derailment.

Figure 3:
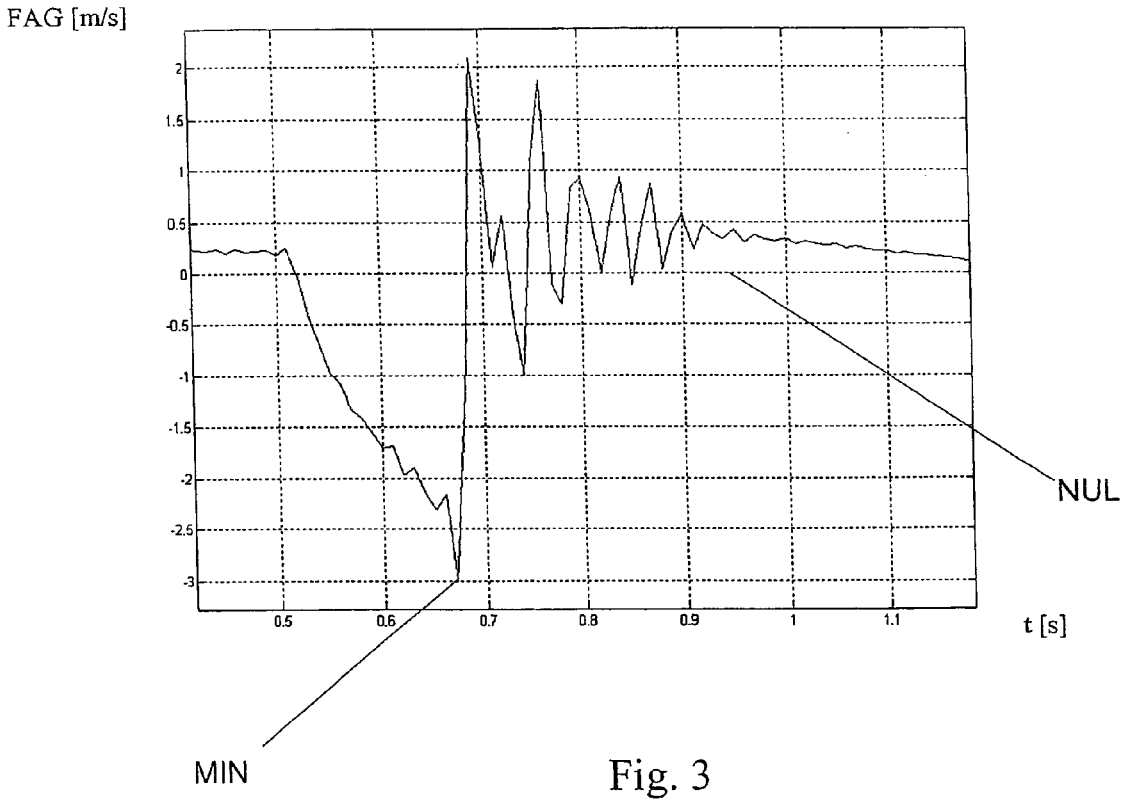
FIG. 3 is a time curve of a fall speed of the rail vehicle in a time window in case of a derailment.

According to FIG. 3, a change in the time curve of the fall speed FAG within the integration interval, which in the illustration shown here is about one second, can correspond to a derailment by a predeterminable value. The time curve of the fall speed FAG, shown in FIG. 3 as mentioned earlier, is obtained by a one-time integration of the acceleration signal BSI, where the action direction of the pertinent acceleration sensor BSE, looking at it from the rail plane ϵ, is pointed "upward" so that a fall motion of the rail vehicle in the direction of the rail plane will occur as a "negative" speed in the curve. Naturally, the action direction of the acceleration sensor BSE could also point in the direction of the rail plane ϵ, whereby one would then get a development of the fall speed FAG that would be reflected along the zero line NUL.

The end of the fall motion of the rail vehicle is characterized by the minimum MIN of the time curve. The minimum MIN in case of a derailment corresponds in terms of time to the impact of the rail vehicle on the roadway. This is followed by a positive value for the fall speed on account of the upward-acting acceleration due to the impact upon the roadway.

Furthermore, the analysis unit ASW can have a filter FIL for the elimination of low-frequency jamming prior to integration, which might, for instance, be caused by drift phenomena and low-frequency electromagnetic interferences in order to improve the signal-to-noise ratio. To achieve a sharp separation between the useful signal and the jamming signal, one preferably uses a filter with a fast transition from its blocking area to its passage area Filters with a fast transition from a blocked to a passed frequency range can alter the phase positions between the individual frequency portions of the signal that is to be integrated. As a result, the course of the fall movement can no longer be correctly reconstructed by means of integration.

This is why one preferably uses a filter that will not alter the phase relationships among the individual frequency portions contained in the signal. This condition is met, for instance, for the Bessel filter or for FIR filters. Preferably, the signal is filtered with a high-pass that belongs to the family of Bessel filters. Bessel filters are preferred over FIR filters for practical applications that are critical in terms of security because comparable FIR filters have a higher reaction time.

Summarizing, one might say that the invention-based method offers a great advantage in that it can also be implemented very easily in terms of hardware technology, and that it is very well suited for practical applications that are critical in terms of safety.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A method for recognition of a derailment state of a wheel of a rail vehicle, comprising the steps of:

measuring acceleration of the wheel perpendicularly to a rail plane with at least one acceleration sensor, determining a fall speed of the wheel in the direction of the rail plane from an acceleration signal generated by the acceleration sensor by means of simple integration over a time window of predeterminable magnitude, and determining whether a derailed state exists on the basis of only the determined fall speed.

2. The method according to claim 1, characterized in that the determined fall speed is compared to a boundary fall speed, where one concludes that there is a derailed state as the boundary fall speed is exceeded.

3. The method according to claim 1, characterized in that one concludes that there is a derailed state from the time curve of the fall speed.

4. The method according to claim 1, characterized in that the acceleration signal is generated in an area of an axle bearing of a wheel of the rail vehicle.

5. The method according to claim 1, characterized in that low-frequency jamming portions, contained in the acceleration signal, are eliminated prior to integration by means of filtration.

6. The method according to claim 1, characterized in that one uses high-pass filtration to eliminate the jamming portions.

7. The method according to claim 1, characterized in that phase relationships of frequency portions of the acceleration signal to be integrated are preserved among each other during filtration.

8. The method according to claim 1, characterized in that the integration of the acceleration signal is performed in each case in successive time windows, where the terminal point of a time window forms the starting point of a subsequent time window.

9. The method according to claim 1, characterized in that the integration of the acceleration signal is performed in each case in successive time windows, where successive time windows overlap each other segment by segment.

10. The method according to claim 1, characterized in that an acceleration signal is generated in the area of each wheel of the rail vehicle.

11. A device for the recognition of a derailment state of a wheel of a rail vehicle, comprising:

at least one acceleration sensor for the acquisition of acceleration of the wheel perpendicularly to a rail plane, whereby the acceleration sensor is set up with an analysis unit for the analysis of an acceleration signal that is generated by the acceleration sensor, and the analysis unit is so outfitted as to determine from the acceleration signal by means of simple integration over a time window of predeterminable magnitude a fall speed of the wheel in the direction of rail plane and where, on the basis of only the determined fall speed, one can examine whether a derailed state exists.

12. The device according to claim 11, characterized in that the analysis unit is so set up as to compare the determined fall speed with a boundary fall speed, where one can conclude that there is a derailed state when the boundary fall speed is exceeded.

13. The device according to claim 11, characterized in that the analysis unit is so set up as to recognize a derailed state on the basis of the time curve of the fall speed.

14. The device according to claim 11, characterized in that the acceleration sensor is arranged in the area of an axle bearing of a wheel on the rail vehicle.

15. The device according to claim 11, characterized in that a filter is provided to eliminate low-frequency jamming portions contained in the acceleration signal prior to integration.

16. The device according to claim 15, characterized in that the filter is a high-pass filter.

17. The device according to claim 15, characterized in that the filter essentially exerts no influence on the phase relationships between frequency portions of the acceleration signal.

18. The device according to claim 11, characterized in that the analysis unit is set up to perform the integration of the acceleration signal each time in successive time windows, where the terminal point of one time window will form the starting point of the subsequent time window.

19. The device according to claim 11, characterized in that the analysis unit is set up to perform the integration of the acceleration signal each time in successive time windows, whereby successive time windows will overlap each other segment by segment.

20. The device according to claim 11, characterized in that an acceleration sensor is arranged in the area of each wheel of the rail vehicle.

* * * * *